US007748583B1

(12) United States Patent
Woltman

(10) Patent No.: US 7,748,583 B1
(45) Date of Patent: Jul. 6, 2010

(54) ARTICLE HOLSTER

(76) Inventor: David Woltman, 1342 Hewlett La., Hewlett Harbor, NY (US) 11557

( * ) Notice: Subject to any disclaimer, the term of this patent is extended or adjusted under 35 U.S.C. 154(b) by 996 days.

(21) Appl. No.: 11/004,726

(22) Filed: Dec. 3, 2004

(51) Int. Cl.
*A45F 5/00* (2006.01)
*A45D 20/12* (2006.01)

(52) U.S. Cl. ..... 224/251; 224/667; 224/242; 224/901; 34/97

(58) Field of Classification Search ..... 224/251, 224/148.4, 148.1, 148.7, 665, 667, 678, 666, 224/904, 926, 242, 901; 248/315; 34/97
See application file for complete search history.

(56) References Cited

U.S. PATENT DOCUMENTS

| | | | | | |
|---|---|---|---|---|---|
| 2,063,554 | A | | 12/1936 | Meyerson | |
| 2,242,833 | A | | 5/1941 | Nibur | |
| 2,903,225 | A | * | 9/1959 | Weinstein | 248/311.2 |
| 4,194,657 | A | * | 3/1980 | Thor | 224/667 |
| 4,294,386 | A | * | 10/1981 | Ingram | 224/667 |
| 4,673,148 | A | | 6/1987 | Oliver | |
| 4,696,447 | A | * | 9/1987 | Strecker | 248/206.3 |
| 4,697,780 | A | * | 10/1987 | Wenkman et al. | 248/558 |
| 4,874,142 | A | * | 10/1989 | Gelatt | 248/185.1 |
| 4,919,381 | A | * | 4/1990 | Buist | 248/154 |
| 4,997,156 | A | | 3/1991 | Allen | |
| 5,220,744 | A | * | 6/1993 | Kendall | 47/39 |
| 5,232,137 | A | * | 8/1993 | Devine | 224/666 |
| 5,489,075 | A | | 2/1996 | Ible | |
| 5,542,636 | A | * | 8/1996 | Mann et al. | 248/229.26 |
| 5,630,517 | A | * | 5/1997 | Maznik | 211/70.6 |
| 5,743,415 | A | * | 4/1998 | Smart | 211/70.6 |
| 5,853,158 | A | | 12/1998 | Riggle | |
| 5,857,601 | A | * | 1/1999 | Greenwood | 224/409 |
| 5,913,463 | A | * | 6/1999 | Carr | 224/148.4 |
| 5,984,251 | A | | 11/1999 | Davis | |
| 6,045,017 | A | * | 4/2000 | Connell | 224/148.7 |
| 6,206,258 | B1 | * | 3/2001 | Calder | 224/420 |
| 6,227,510 | B1 | | 5/2001 | McMullen, Sr. | |
| 6,601,813 | B1 | | 8/2003 | Kager et al. | |
| D497,688 | S | * | 10/2004 | Issa | D28/18 |
| 2004/0238577 | A1 | * | 12/2004 | Shivas | 224/148.4 |

FOREIGN PATENT DOCUMENTS

| | | | |
|---|---|---|---|
| DE | 4227829 | | 6/1993 |
| DE | 19824690 | | 12/1999 |
| WO | WO 03099059 | A1 * | 12/2003 |

* cited by examiner

*Primary Examiner*—Nathan J Newhouse
*Assistant Examiner*—Justin M Larson
(74) *Attorney, Agent, or Firm*—Michael I Kroll

(57) ABSTRACT

Apparatus 10 for an article holder 26 having opposing pliable arms forming means 32 for attaching the holder to an article of clothing or mounting to a structure using the fastener mounting aperture 36. Depending from the closed distal end of the pliable arms is a cantilevered ring serving as the article holder 26 having a divergent tongue 28 extending therefrom adjacent to the pliable arms with one of the arms having a protrusion forming a support element 42 for the tongue terminus. Once an article, such as a handheld blow dryer 12, is placed therein, the tongue 28 directs the nozzle of the blower away from the user 14.

6 Claims, 12 Drawing Sheets

ARTICLE HOLSTER

BACKGROUND OF THE INVENTION

1. Field of the Invention

The present invention relates generally to receptacles and, more specifically, to an article holder having opposing pliable arms forming means for attaching the holder to an article of clothing or mounting to a structure using the fastener mounting aperture. Depending from the closed distal end of the pliable arms is a cantilevered ring serving as the article holster having a divergent tongue extending therefrom adjacent to the pliable arms with one of said arms having a protrusion forming a support element for the tongue terminus. Once an article, such as a handheld blow dryer is placed therein, the tongue directs the nozzle away from the user.

2. Description of the Prior Art

There are other receptacle devices designed for receiving articles. Typical of these is U.S. Pat. No. 2,063,554 issued to Meyerson on Dec. 8, 1936.

Another patent was issued to Nibur on May 20, 1941 as U.S. Pat. No. 2,242,833. Yet another U.S. Pat. No. 4,673,148 was issued to Oliver on Jun. 16, 1987 and still yet another was issued on Sep. 29, 1987 to Strecker as U.S. Pat. No. 4,696,447.

Another patent was issued to Allen on Mar. 5, 1991 as U.S. Pat. No. 4,997,156. Yet another U.S. Pat. No. 5,489,075 was issued to Ible on Feb. 6, 1996. Another was issued to Riggle on Dec. 29, 1998 as U.S. Pat. No. 5,853,158 and still yet another was issued on Nov. 16, 1999 to Davis as U.S. Pat. No. 5,984,251.

Another patent was issued to McMullen on May 8, 2001 as U.S. Pat. No. 6,227,510. Yet another U.S. Pat. No. 6,601,813 was issued to Kager on Aug. 5, 2003. Another was issued to Boehm on Dec. 9, 1999 as German Patent No. DE 19824690 and still yet another was issued on Jun. 24, 1993 to Herold as German Patent No. DE4227829.

U.S. Pat. No. 2,063,554

Inventor: L. B. Meyerson

Issued: Dec. 8, 1936

In a bottle holder in combination, a broad shallow hollow conical base and an upright U shaped bracket centrally secured thereto, a sleeve pivoted near one end in said bracket, and means in the sleeve end remote from said pivots adapted to engage the shoulder of a nursing bottle.

U.S. Pat. No. 2,242,833

Inventor: B. Niber

Issued: May 20, 1941

A table attachment comprising a wire holder including a ring portion, parallel leg members each formed of a double thickness of wire and projecting radially from one edge of the ring portion, a rigid plate having tubular portions receiving the respective leg members and a resilient wire clamping member extending outwardly from said tubular portions and cooperating with said leg members for clamping the holder to a supporting structure.

U.S. Pat. No. 4,673,148

Inventor: James A. Oliver

Issued: Jun. 16, 1987

A holder device adapted to be affixed to a vertical wall accommodates an electric hair dryer having an elongated barrel and permits easy insertion of the dryer into and removal from the holder. The holder has a mounting bracket and an arm pivotably engaged by the bracket and adapted to be easily moved between a vertically pendant position and a horizontally disposed position. When the arm is in its horizontal position with the dryer engaged therein, the dryer may be utilized in a hands-free mode.

U.S. Pat. No. 4,696,447

Inventor: Dennis Strecker

Issued: Sep. 29, 1987

The handle portion of a hair dryer is seated within a retainer and held positioned therein by abutment with a curved backstop depending from the retainer. The retainer and backstop are rigidified by a rib interfitted with and pivotally connected to a rigid projection from a base in alignment with a vertical pivot plane. The base is attached to a vertical support surface by at least two suction cups equally spaced from the pivot plane above the horizontal pivot axis about which the retainer is angularly adjusted to a desired oriented position.

U.S. Pat. No. 4,997,156

Inventor: Lois Allen

Issued: Mar. 5, 1991

A holder for a beverage container is mountable on tubular chair legs or like members having wide-rangingly different angles of inclination and diameters. The holder provides for plumb positioning of a beverage container and for deterring tilting and toppling of the container. Preferably, a diameter-adjustable, container-encircling member provides for closely confining containers having different diameters. The holder includes a rotatably positionable, mounting clamp member, a receptacle member and a connecting member, which connecting member angularly and pivotably associates the clamp member with the receptacle member, thereby providing for said plumb positioning of said receptacle member, moment deterrence to said tilting and dispositional deterrence to said toppling. Preferably, the connecting member and the receptacle member are integrally formed out of manually-bendable metal rod material, which provides for said adjustability of the container-encircling member. The metal rod material preferably is plastic-covered through for insulating against temperature variations to which the metal is subject and for cosmetic purposes. Alternatively, the holder may be fabricated in whole or in part of plastic materials. The holder also provides for facilitating bottom-lifting of deformable paper cups for secure handling.

U.S. Pat. No. 5,489,075

Inventor: Robert L. Ible

Issued: Feb. 6, 1996

A baby bottle holder and feeder including a lightweight, hollow articulating arm having a clamp member affixed at one end for the purpose of holding a baby bottle for feeding and having another clamp member affixed at the opposite end for the purpose of clamping the baby bottle holder and feeder to a nearby object such as a baby's car seat. The articulating arm is generally of plastic composition and permits movement by a child as required to initiate, perform, and terminate self feeding. The clamp member holding the baby bottle is spring actuated and having pads between planar extensions of the jaws of the clamp member for softening impact therebetween subsequent to removal of the bottle should an older child desire such release.

U.S. Pat. No. 5,853,158

Inventor: Christopher T. Riggle

Issued: Dec. 29, 1998

A new beverage container holder for providing an adjustably positionable device for holding a beverage to a structure. The inventive device includes a receptacle member for holding a beverage container coupled to an elongate arm member. A connection means connects the arm member to a clamping assembly designed for detachable attachment to a structure. The connection means includes a first pivot member, a second pivot member, and a rotation member to permit selective and adjustable positioning of the receptacle member in relation to the structure.

U.S. Pat. No. 5,984,251

Inventor: Patrick H. Davis

Issued: Nov. 16, 1999

A new holder for holding a light source, especially a hand held light source, to a structure. The inventive device includes a frame having a holding portion and a pair of spaced apart arm portions which are pivotally coupled to a mounting frame. The holding portion is generally annular and has a pair of opposing ends defining a break between them. Each of the arm portions are each extended from an associated end of said holding portion. The terminal ends of the arm portions are pivotally coupled to the mounting plate which is designed for mounting to a structure. The holding portion is biased in a direction towards the mounting plate.

U.S. Pat. No. 6,227,510

Inventor: Donald A. McMullen

Issued: May 8, 2001

A holder for a hand size container for use in conjunction with a portable chair. The holder comprises an integral body portion and a clamping means for attaching the holder to the portable chair. The integral body portion consists of an annular band having an inside diameter sized to receive a handheld container, first and second arcuate legs, and a horizontal double-beam-flange member which cooperate to securely and removably hold and support a container placed within the annular band. The annular band may include a discontinuity to accommodate the passage through the annular band of a protruding part of the container, for example, a cup handle. The clamping means is affixed to an end of the horizontal double-beam-flange member so as to provide a means for removably attaching the holder to a portable chair. In some embodiments of the present invention, the affixation of the clamping means to the integral body portion is by way of a part of the clamping means being an integral part of the integral body portion of the holder. In other embodiments, the clamping means is affixed to the proximal end of the horizontal flange member by way of a mechanical fastener.

U.S. Pat. No. 6,601,813

Inventor: Kevin F. Kager, et al.

Issued: Aug. 5, 2003

A holder for supporting and holding at least one article relative to and spaced apart from a support surface is provided. The holder includes a receptacle, a clamp configured to couple the receptacle to the support surface, and a coupling arm coupled between the receptacle and the clamp. The coupling arm is coupled to the receptacle at a receptacle coupling joint, and the coupling arm is coupled to said clamp at a clamp coupling joint. Both the receptacle coupling joint and the clamp coupling joint permit movement in more than one plane. Preferably, at least one of the coupling joints is a ball joint.

German Patent Number DE 198246900

Inventor: Boehm Hans-Georg

Issued: Dec. 9, 1999

The hair dryer has a ventilation part, shaped like a shower head and attached to an L-shaped round bar, which can be rotated around a vertical axle integrated in the handle. A U-shaped holding element, swivel mounted to the wall, is joined to the handle from below. Preferred Features: The dryer can be swung into various positions according to the needs of its user. Foldable deflectors are joined to the rim of the ventilation area, facilitating the air stream to concentrate on the head of the person positioned underneath.

German Patent Number DE 4227829

Inventor: Herold Ernest

Issued: Jun. 24, 1993

The hair dryer has an electrically-driven fan attached to a belt worn around the waist of the hairdresser and coupled via a feed hose to a heated nozzle head for directing a hot airstream onto the hair. A current lead extends between the fan and a current source clipped to the back of the hairdressing chair, in turn coupled via a main current lead to an electric wall socket. Pref. the fan is attached to the belt via a clip at its rear to allow its easy detachment. ADVANTAGE—Stylist has relatively small weight to support in hand.

While these receptacles may be suitable for the purposes for which they were designed, they would not be as suitable for the purposes of the present invention, as hereinafter described.

SUMMARY OF THE PRESENT INVENTION

The present invention discloses an article holder having opposing pliable arms forming means for attaching the holder to an article of clothing or mounting to a structure using the fastener mounting aperture. Depending from the closed distal end of the pliable arms is a cantilevered ring serving as the article holder having a divergent tongue extending therefrom adjacent to the pliable arms with one of the arms having a protrusion forming a support element for the tongue terminus. Once an article, such as a handheld blow dryer, is placed therein, the tongue directs the nozzle of the blower away from the user.

A primary object of the present invention is to provide a receptacle for a blow dryer.

Another object of the present invention is to provide a receptacle for a blow dryer that can be fastened to an article of clothing.

Yet another object of the present invention is to provide a receptacle for a blow dryer that can be fastened to a structure.

Still yet another object of the present invention is to provide a receptacle for a blow dryer having opposing pliable arms forming means for attaching the holder to an article of clothing.

Another object of the present invention is to provide a receptacle for a blow dryer having opposing pliable arms with an aperture forming means for attaching the holder to a structure.

Yet another object of the present invention is to provide a receptacle for a blow dryer having a cantilevered ring depending from the closed distal end of the pliable arms.

Still yet another object of the present invention is to provide a receptacle for a blow dryer having a tongue extending from said ring directing the dryer nozzle away from the user.

Additional objects of the present invention will appear as the description proceeds.

The present invention overcomes the shortcomings of the prior art by providing an article holder having opposing pliable arms forming means for attaching the holder to an article of clothing or mounting to a structure using the fastener mounting aperture. Depending from the closed distal end of the pliable arms is a cantilevered ring serving as the article holster having a divergent tongue extending therefrom adjacent to the pliable arms with one of said arms having a protrusion forming a support element for the tongue terminus. Once an article, such as a handheld blow dryer is placed therein, the tongue directs the nozzle away from the user.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
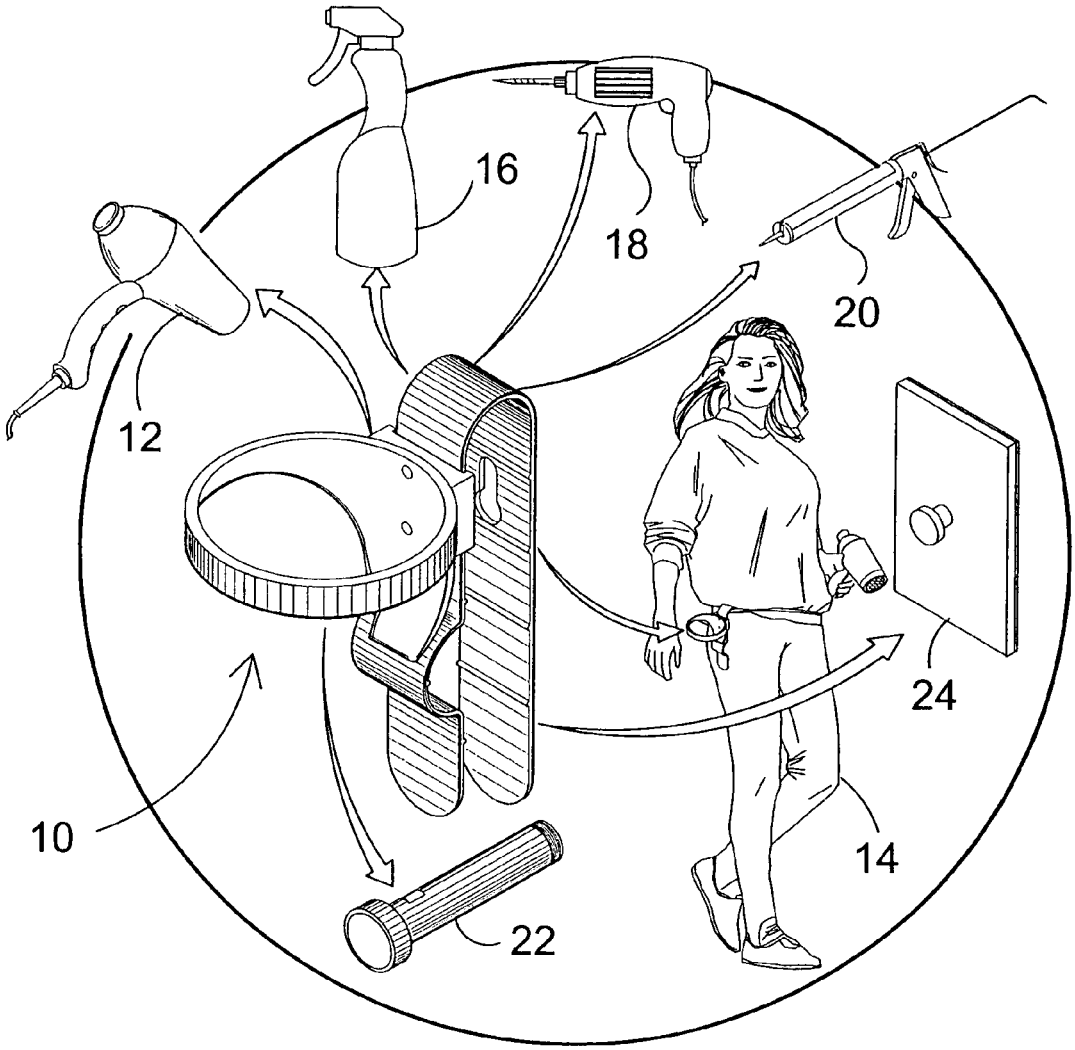
FIG. 1 is an illustrative view of the present invention and its use.

With regard to reference numerals used, the following numbering is used throughout the drawings.

10 present invention
12 hair blow dryer
14 user
16 spray bottle
18 power tool
20 outdoor tool
22 flashlight
24 wall mount
26 holder
28 deflector
30 blower output
32 clip
34 serrations
36 aperture
38 wall
40 mounting holes
42 level support
44 adhesive
46 hanger
48 wall

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 and its use. The present invention 10 discloses a holder for a hair dryer 12 having spaced apart pliable arms forming a clip with means attached thereto for selectively inserting and extracting the hair dryer or other tools therefrom. The holder comprises a circular-like wall with a throughbore for inserting a blow dryer 12 or other tool therein. The device can be worn by a user 14 selectively positioned on an article of clothing or may be placed on a wall mount. Also disclosed are spray bottle 16, power tools 18, outdoor tools 20, flashlight 22 for use with device 10 or it can be attached to wall mount 24.

Figure 2:
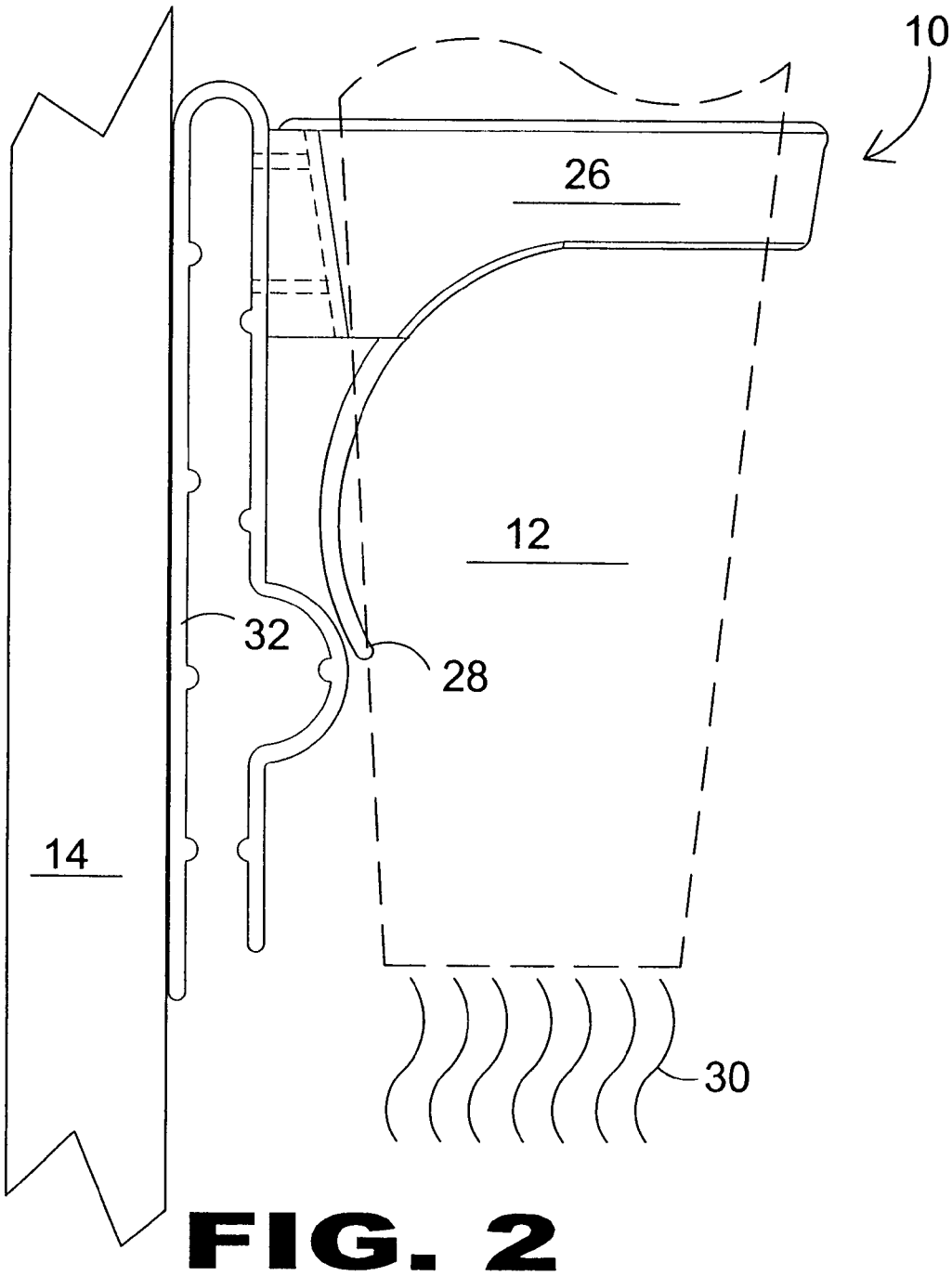
FIG. 2 is a side view of the present invention in use.

Turning to FIG. 2, shown therein is a side view of the present invention 10 in use. Shown is a side view of the present invention 10 being employed by a user 14. The holder 26 can fasten to structural member or articles of clothing. The holder 26 forms a receiver for a portable electric hairdryer 12. In those applications where a hairdryer 12 is turned on and used intermittently, the holder 26 forms a receiver whereby an arcuate air deflector 28 within the holder directs the dryer output 30 to the front of the device 10 away from the user 14 thereby providing means for the dryer to be left on and close at hand. Also shown is clip 32.

Figure 3:
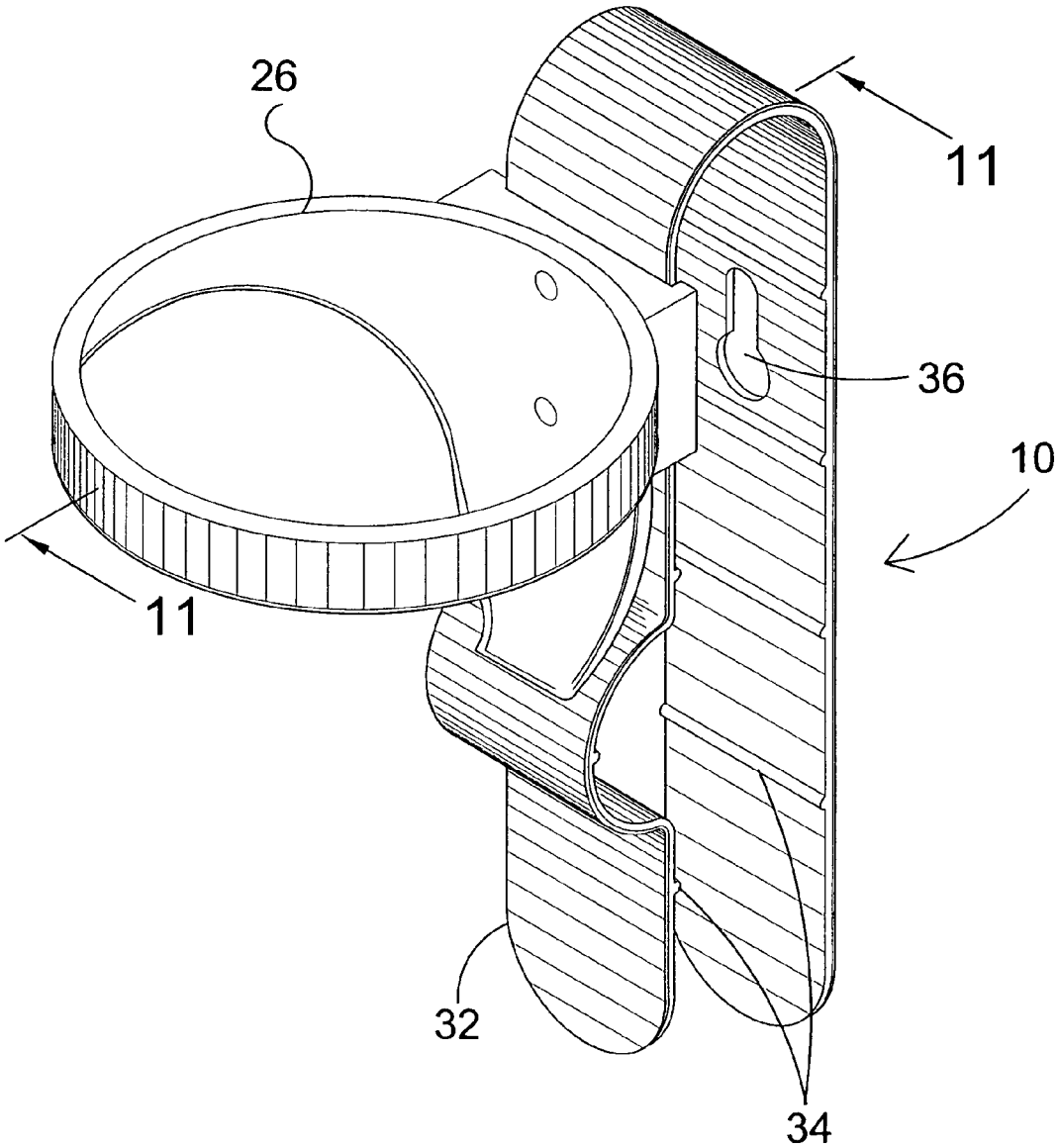
FIG. 3 is a perspective view of the present invention.

Turning to FIG. 3, shown therein is a perspective view of the present invention 10. Shown is a perspective view of the present invention 10 disclosing a holder 26 for a hair dryer having spaced apart pliable arms forming a clip 32 with means attached thereto for selectively inserting and extracting a hair dryer or other tool therefrom. The holder 26 comprises a circular-like wall with a throughbore for inserting a blow dryer or other tool therein. The device 10 can be worn by a user selectively positioned on an article of clothing or may be wall mounted. Also shown are serrations or grips 24 on clips 32 and wall mounting aperture 36.

Figure 4:
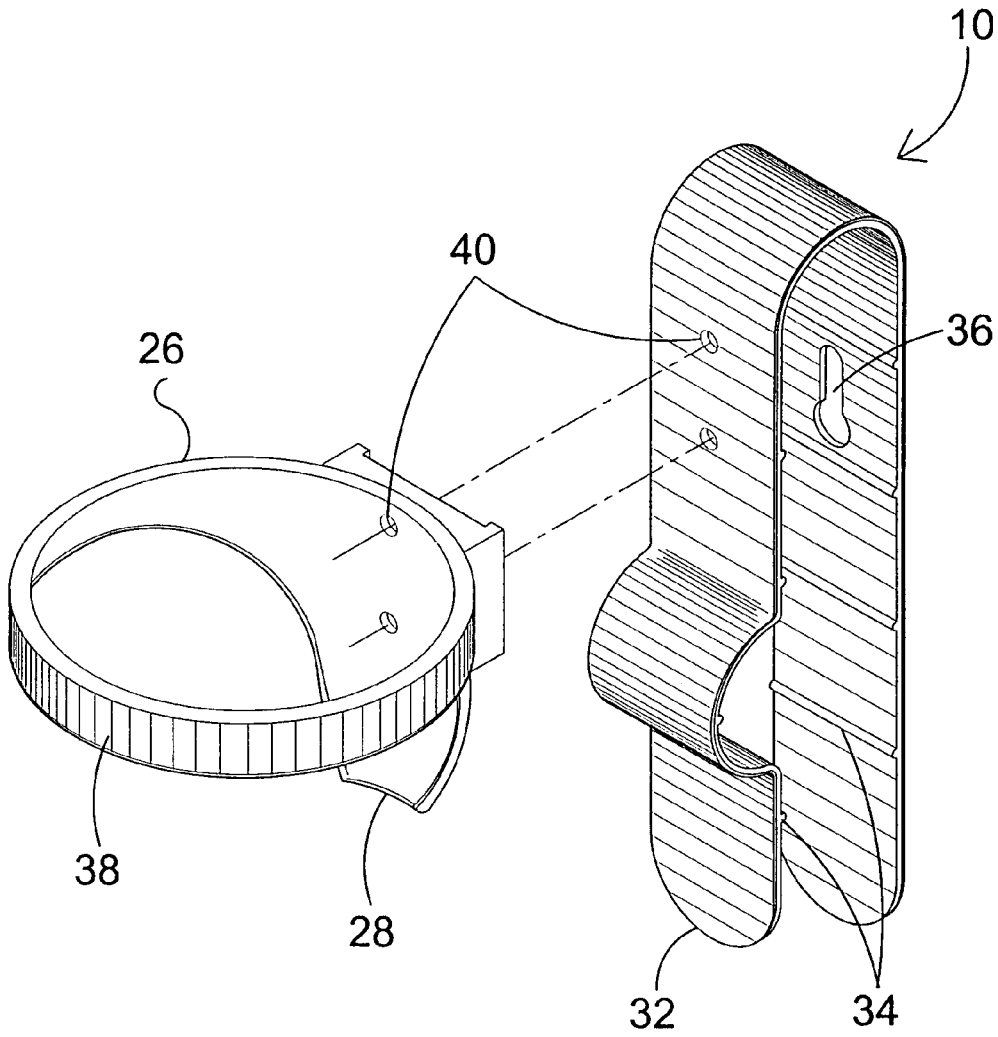
FIG. 4 is an exploded view of the present invention.

Turning to FIG. 4, shown therein is an exploded view of the present invention 10. Shown is an exploded view of the present invention 10 disclosing a holder 26 for a hair dryer having spaced apart pliable arms forming a clip 32 with serrations 34 with means attached thereto for selectively inserting and extracting the hair dryer or other tool therefrom. The holder 26 comprises a circular-like wall 38 with an arcuate air deflector 28 with a throughbore for inserting a blow dryer or other tool therein. The air deflector 28 deflects air away from a user toward the front of the device 10. The device 10 can be worn by a user selectively positioned on an article of clothing or may be wall mounted using aperture 36. Also shown are mounting holes 40 on the rear of wall 38.

Figure 5:
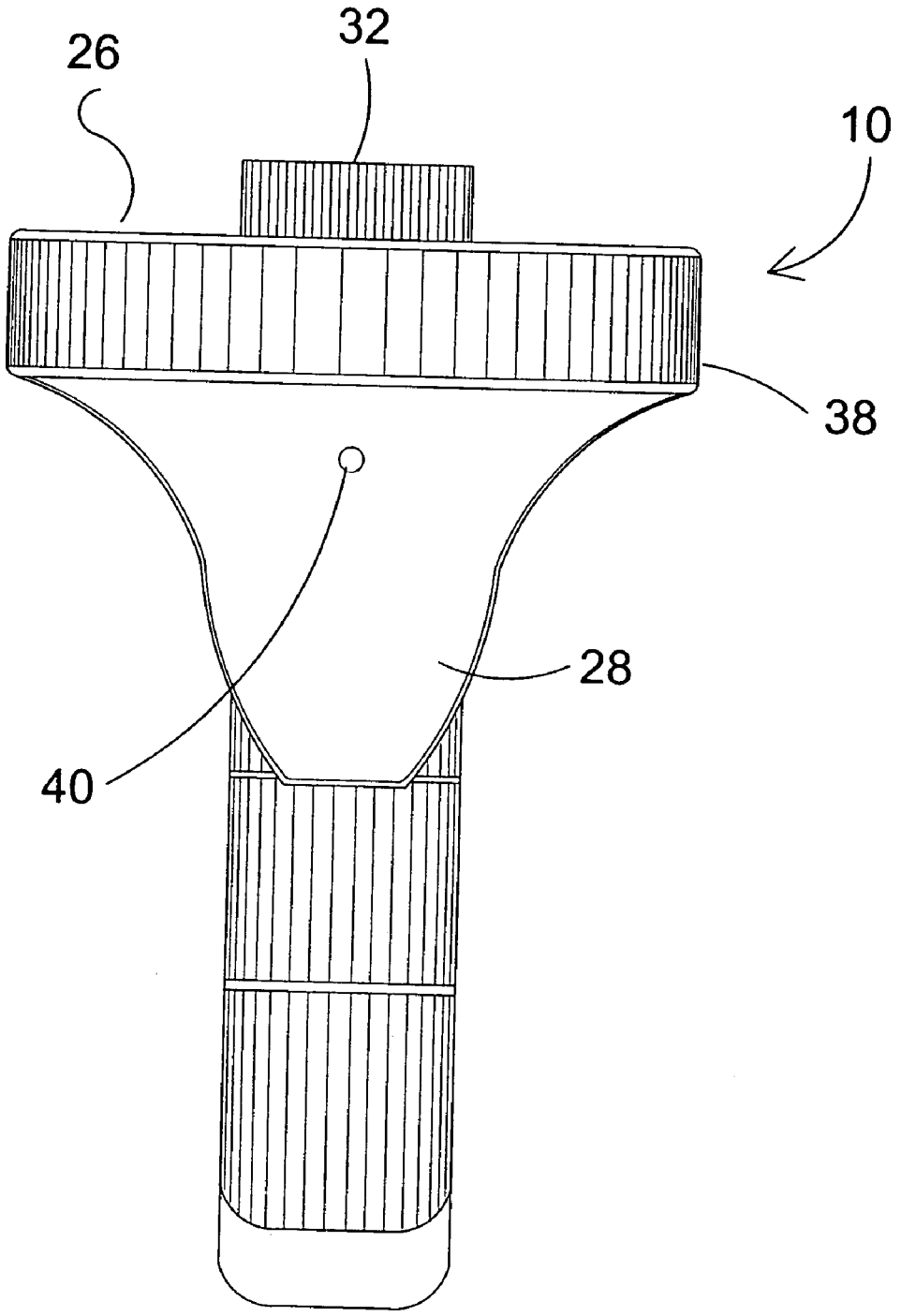
FIG. 5 is a front view of the present invention.

Turning to FIG. 5, shown therein is a front view of the present invention 10. Shown is a front view of the present invention 10 disclosing a holder 26 for a hair dryer having spaced apart pliable arms forming a clip 32 with means attached thereto for selectively inserting and extracting the hair dryer or other tool therefrom. The holder 26 comprises a circular-like wall 38 with deflector 28 with a throughbore for inserting a blow dryer or other tool therein. The device 10 can be worn by a user selectively positioned on an article of clothing or may be wall mounted. Also shown are mounting holes 40.

Figure 6:
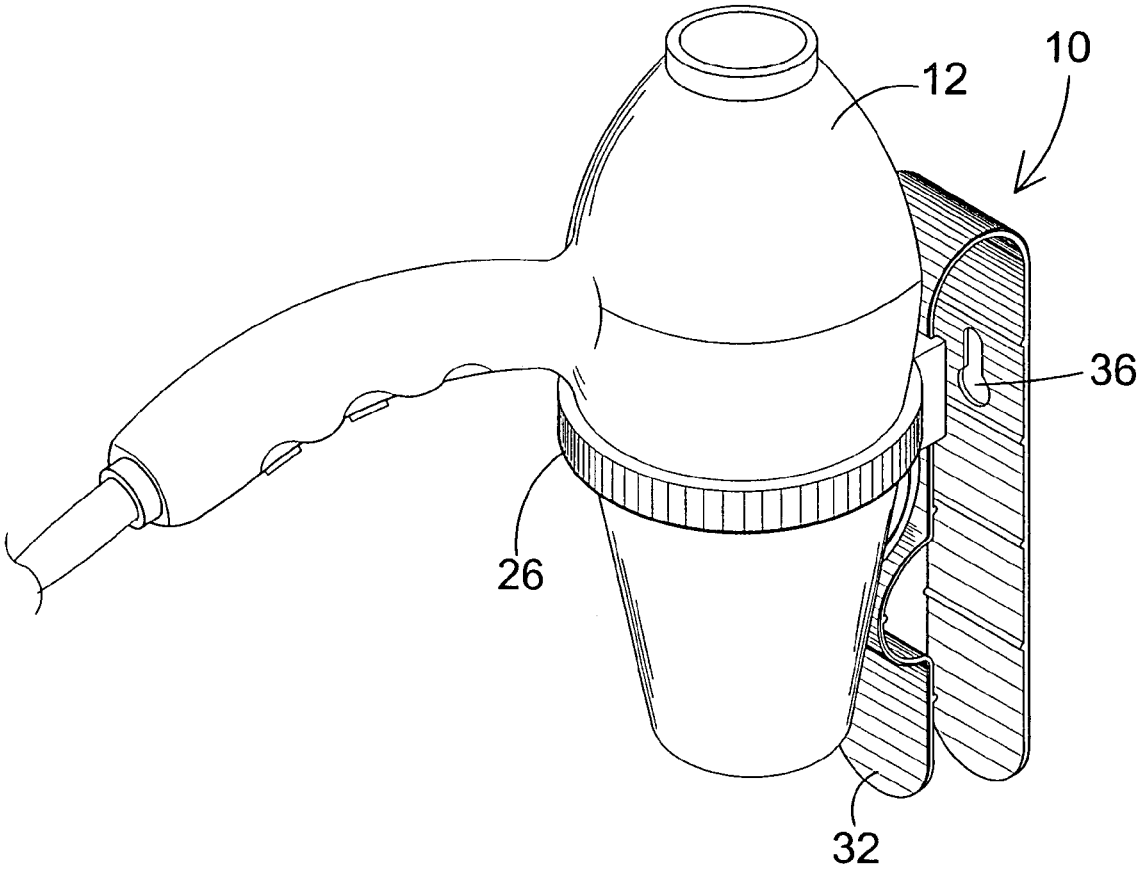
FIG. 6 is an illustrative view of the present invention in use.

Turning to FIG. 6, shown therein is an illustrative view of the present invention 10 in use. Shown is the present invention 10 disclosing a holder 26 for a hair dryer 12 having spaced apart pliable arms forming a clip 32 with means attached thereto for selectively inserting and extracting the hair dryer or other tool therefrom. The holder 10 comprises a circular-like wall with a throughbore for inserting a blow dryer 12 or other tool therein. The device 10 can be worn by a user selectively positioned on an article of clothing or may be wall mounted using aperture 36.

Figure 7:
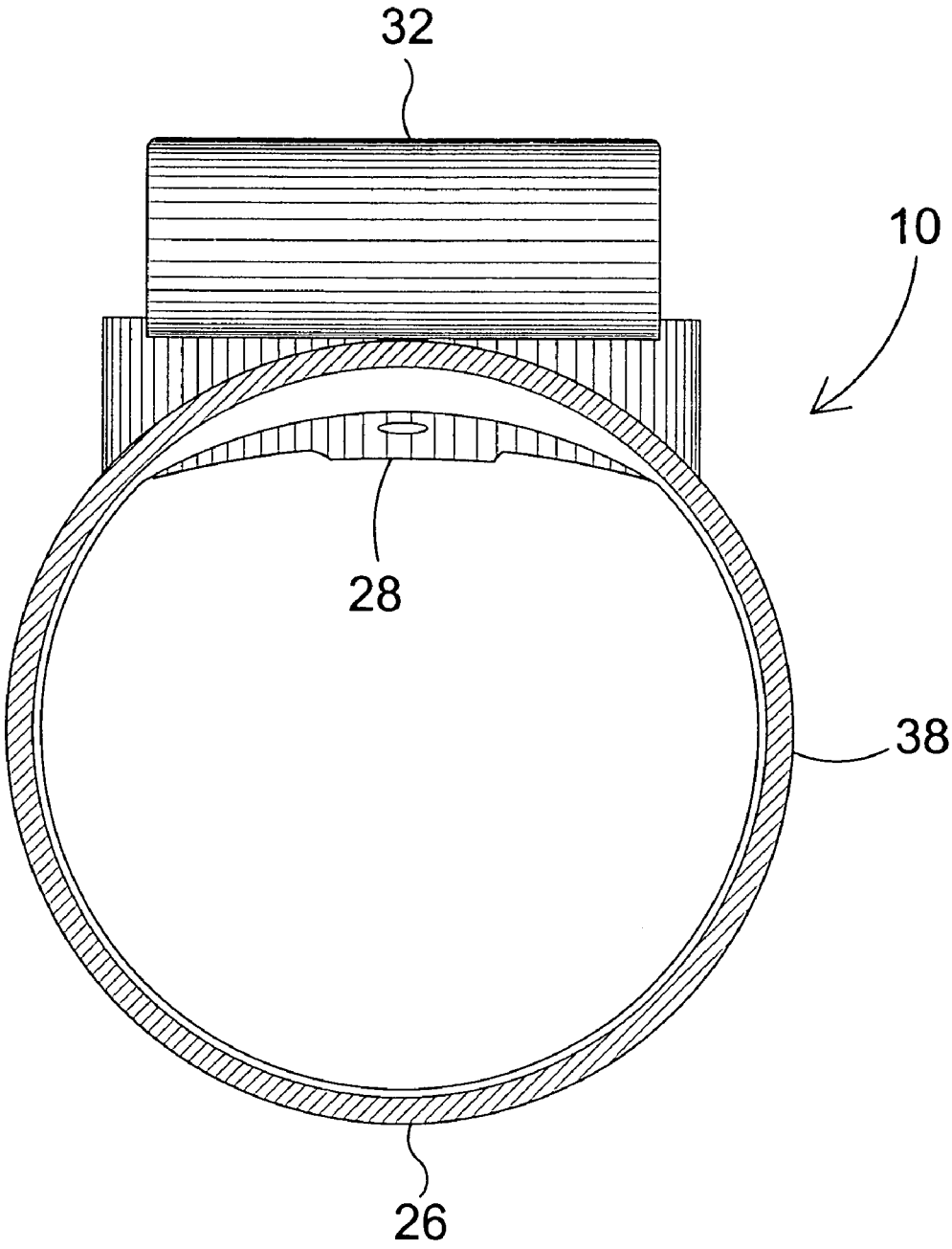
FIG. 7 is a top view of the present invention.

Turning to FIG. 7, shown therein is a top view of the present invention 10. Shown is a stop view of the present invention 10 disclosing a holder 26 for a hair dryer having spaced apart pliable arms forming a clip 32 with means attached thereto for selectively inserting and extracting the hair dryer or other tool therefrom. The holder 26 comprises a circular-like wall 38 with a throughbore and deflector 28 for inserting a blow dryer or other tool therein. The device 10 can be worn by a user selectively positioned on an article of clothing or may be wall mounted.

Figure 8:
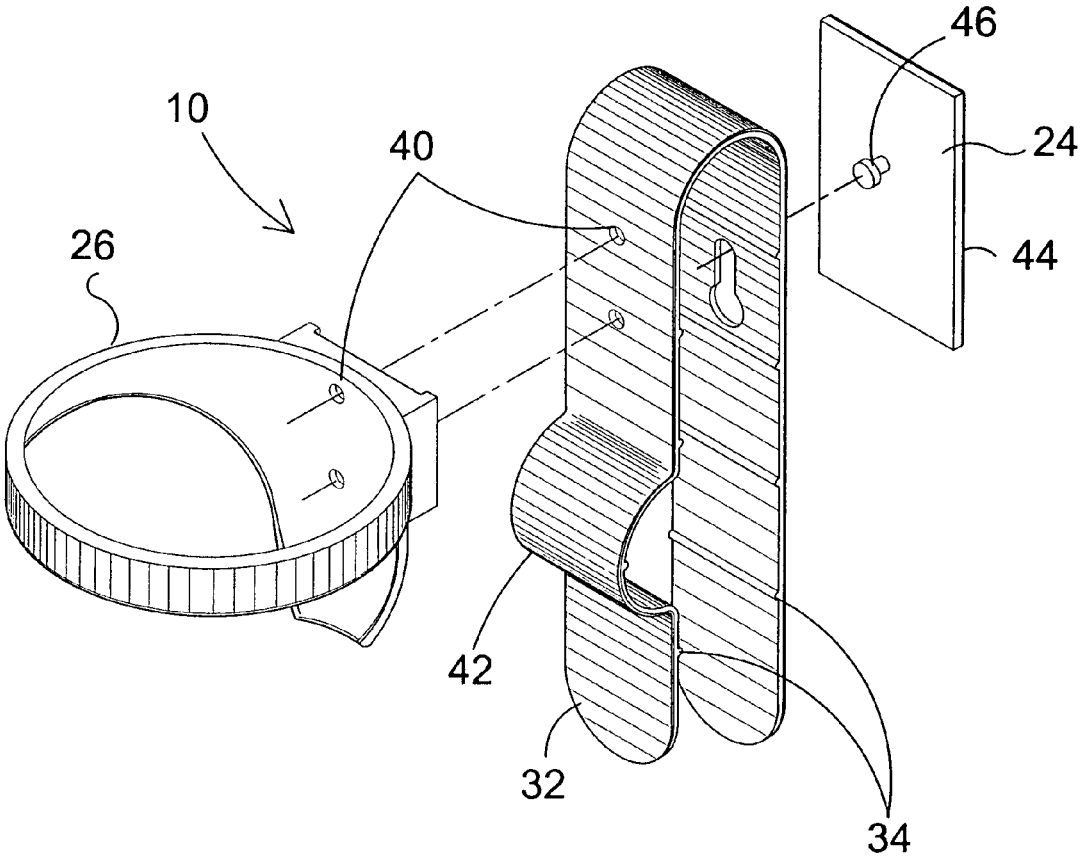
FIG. 8 is an exploded view of the present invention having a wall mount.

Turning to FIG. 8, shown therein is an exploded view of the present invention 10 having a wall mount. Shown is an exploded view of the present invention 10 disclosing a holder 26 for a hair dryer having spaced apart pliable arms forming a clip 32 with serrations 34 with means attached thereto for selectively inserting and extracting the hair dryer or other tool therefrom. The holder 26 comprises a circular-like wall with a throughbore for inserting a blow dryer or other tool therein. At least one of the arms comprises a level support 42 for holder when blower is positioned in clip. The device 10 can be worn by a user selectively positioned on a user's trousers or can be placed within its wall mount 24 which is adhesively at 44 on its back attached to a wall. Also shown are mounting holes 40 and wall hangar 46.

Figure 9:
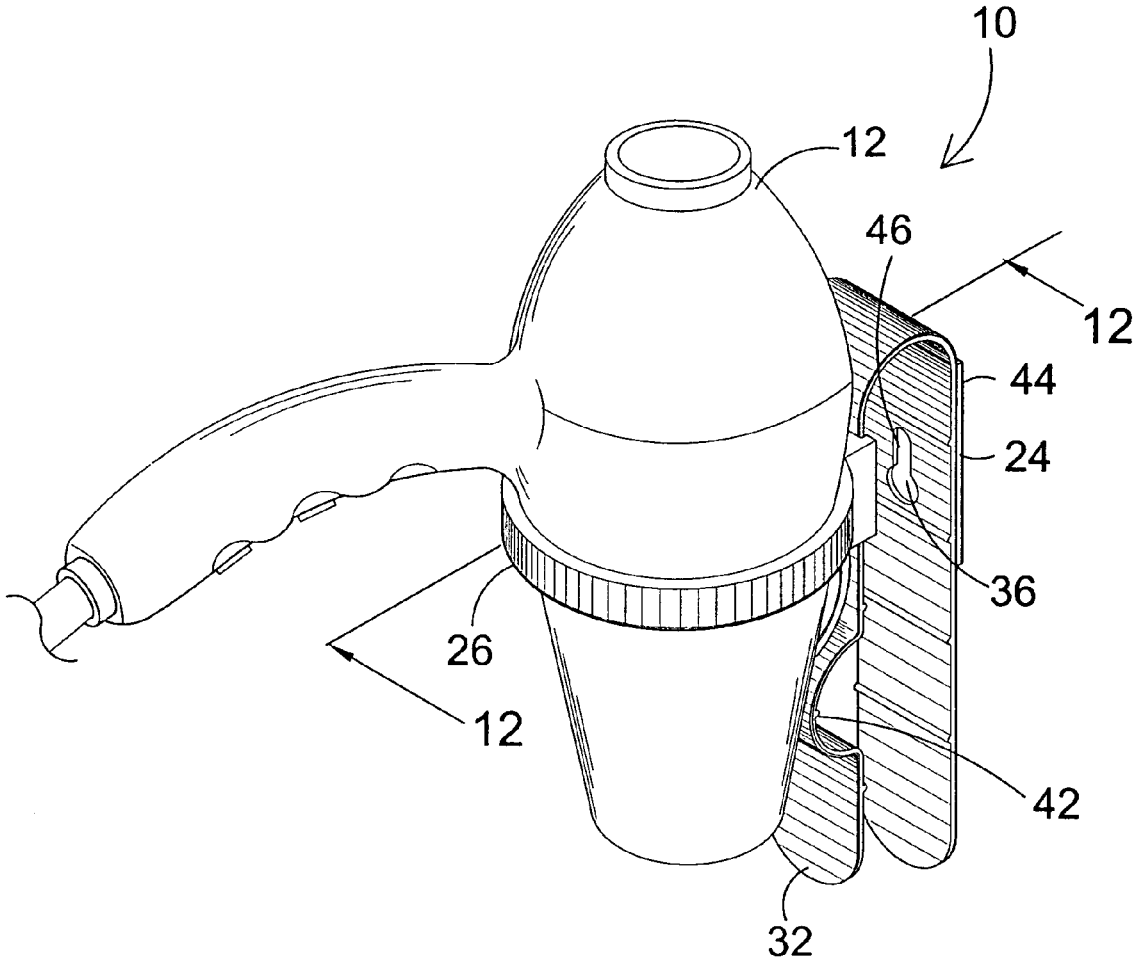
FIG. 9 is a perspective view of the present invention having a wall mount.

Turning to FIG. 9, shown therein is a perspective view of the present invention 10 having a wall mount. Shown is a perspective view of the present invention 10 disclosing a holder 26 for a hair dryer having spaced apart pliable arms forming a clip 32 with means attached thereto for selectively inserting and extracting the hair dryer 12 or other tool therefrom. The holder 26 comprises a circular-like wall with a throughbore for inserting a blow dryer or other tool therein. At least one of the arms comprises a level support 42 for the holder 26 when a blower 12 is positioned in the holder. The device 10 can be worn by a user selectively positioned on a user's trousers or can be placed within on wall mount 24 which is adhesively attached at 44 to a wall. Also shown are hanger 46 and wall mounting aperture 36.

Figure 10:
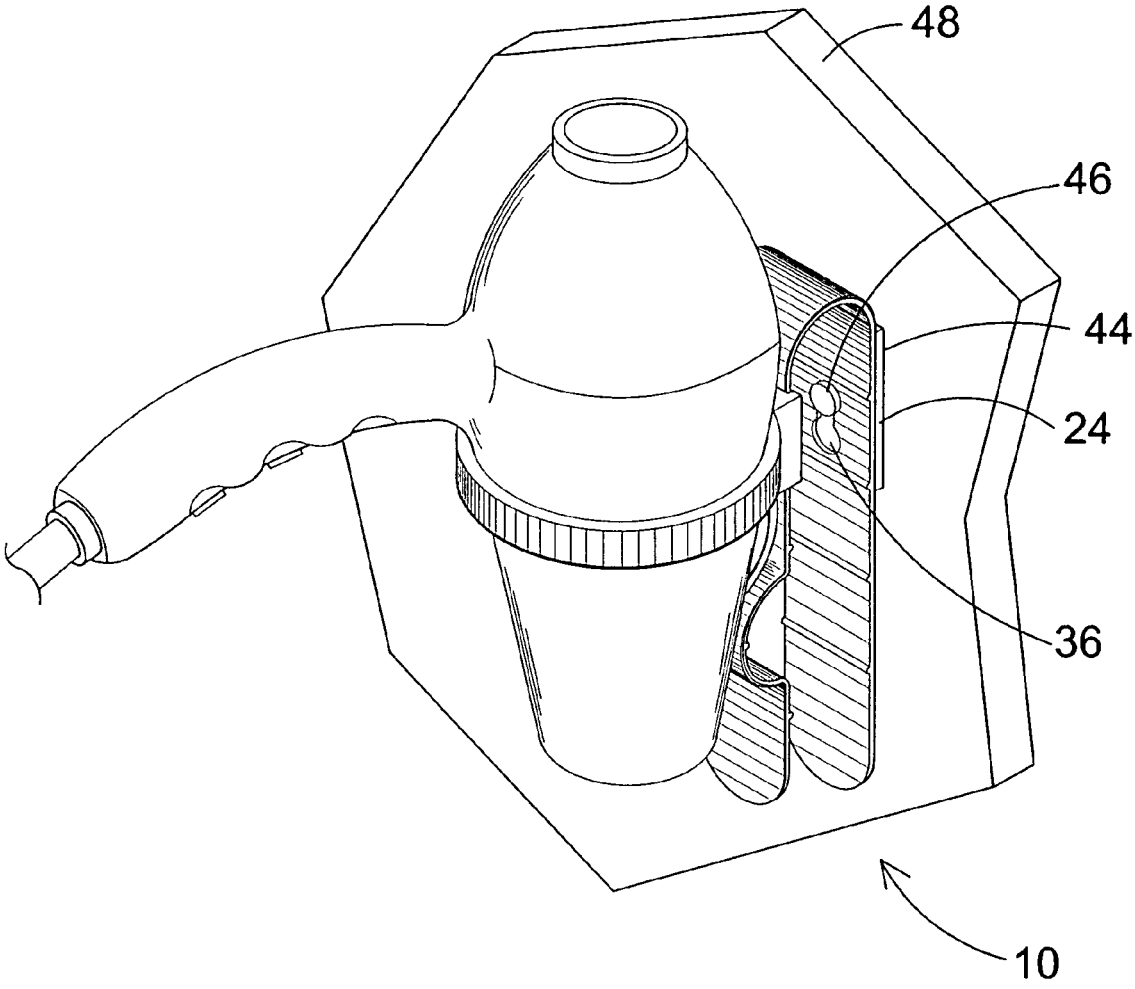
FIG. 10 is a perspective view of the present invention having a wall mount.

Turning to FIG. 10, shown therein is a perspective view of the present invention 10 having a wall mount 24. Shown is a perspective view of the present invention 10 disclosing a holder for a hair dryer having spaced apart pliable arms forming a clip with means attached thereto for selectively inserting and extracting the hair dryer or other tool therefrom. The holder comprises a circular-like wall with a throughbore for inserting a blow dryer or other tool therein. The device 10 can be worn by a user selectively positioned on a user's trousers or can be placed within on wall mount 24 which is adhesively attached at 44 to a wall 48 using hanger 46 in aperture 36.

Figure 11:
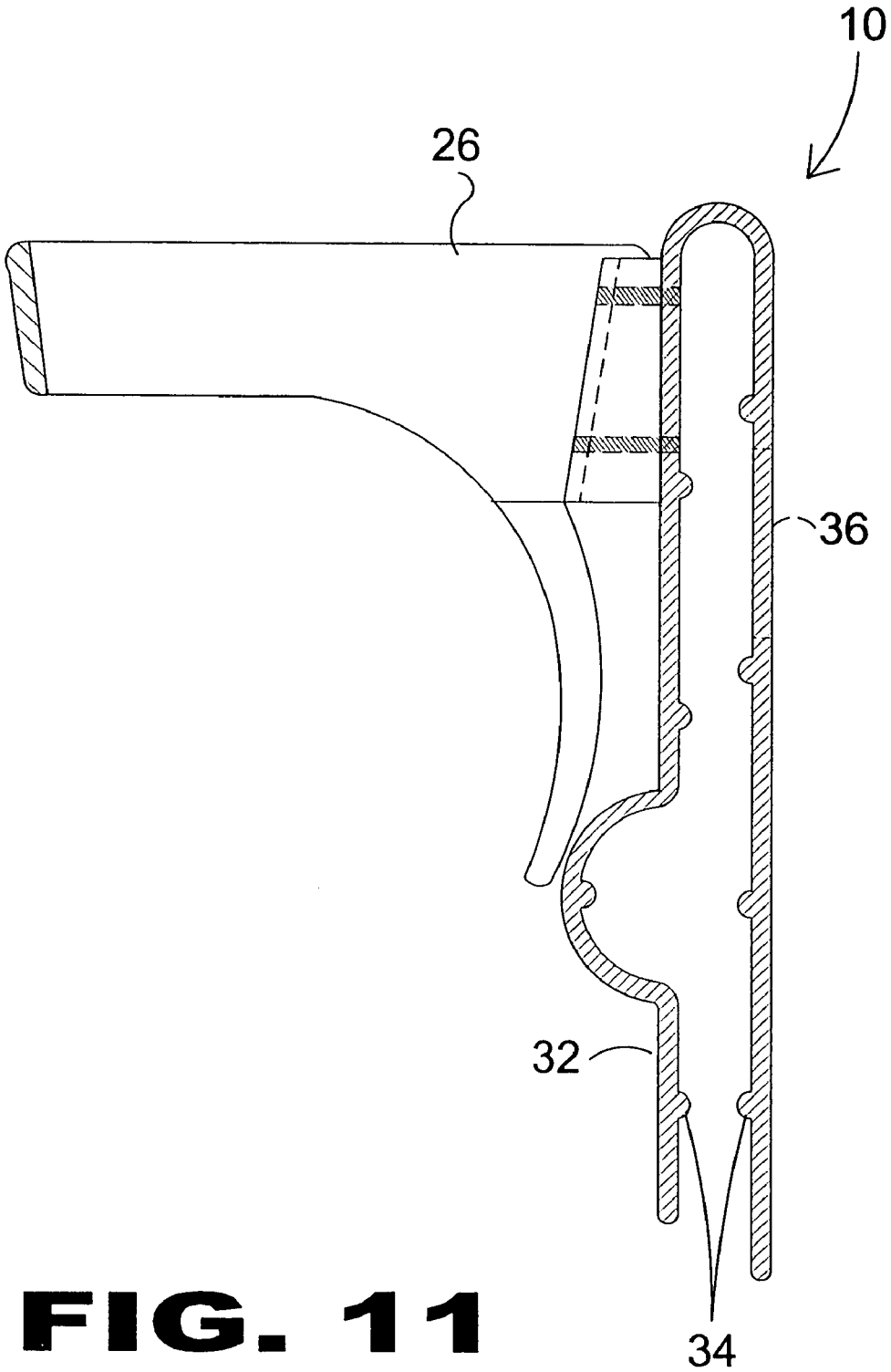
FIG. 11 a cross sectional view of the present invention.

Turning to FIG. 11, shown therein a cross sectional view of the present invention 10. Shown is a cross sectional view of the present invention 10 disclosing a holder 26 for a hair dryer having spaced apart pliable arms forming a clip 32 with serrations 34 with means attached thereto for selectively inserting and extracting the hair dryer or other tool therefrom. The holder 26 comprises a circular-like wall with a throughbore for inserting a blow dryer or other tool therein. The device 10 can be worn by a user selectively positioned on an article of clothing or may be wall mounted using aperture 36.

Figure 12:
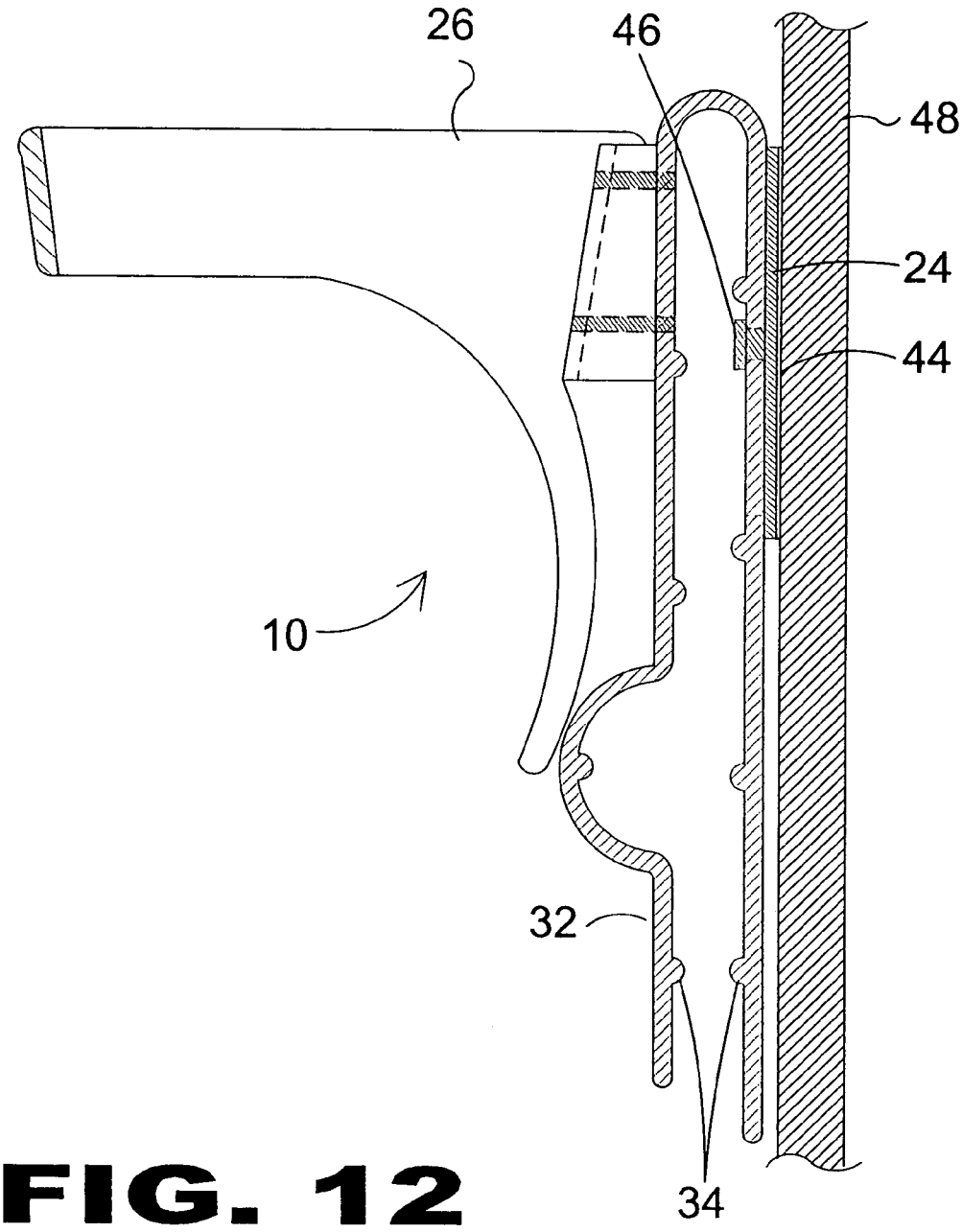
FIG. 12 a cross sectional view of the present invention and wall mount.

Turning to FIG. 12, shown therein a cross sectional view of the present invention 10 and wall mount 24. Shown is a cross sectional view of the present invention 10 disclosing a holder 26 for a hair dryer having spaced apart pliable arms forming a serrated portion at 34 having clip 32 with means attached thereto for selectively inserting and extracting the hair dryer or other tool therefrom. The holder 26 comprises a circular-like wall with a throughbore for inserting a blow dryer or other tool therein. The device 10 can be worn by a user selectively positioned on an article of clothing or may be wall mounted. Also shown are hanger 46, adhesive 44, and wall 48.

I claim:

1. A hair dryer in combination with an apparatus for holding the cylindrically shaped barrel of the hair dryer, the combination comprising:

a) a circular receptacle, said receptacle having a wall with a throughbore therein, said throughbore having a central vertical axis extending through the circular receptacle, said through bore having an inner wall that is tapered with respect to the central vertical axis, wherein said barrel fits into said receptacle and extends below said wall, said receptacle having a front and rear side;

b) a clip having spaced apart front and rear opposing arms, each said front and rear arm having an inside and outside surface and an upper and lower portion, wherein said arms are downwardly extending, wherein said rear side of said receptacle is connected to said upper portion of said outside surface of said front arm to permit the clip and receptacle to be attached to an article of clothing of a user;

c) the wall of said circular receptacle forming an air deflector in the shape of an arc extending down from a portion of said wall, said air deflector curved about an axis perpendicular to said central vertical axis, said air deflector having upper and lower portions, said upper portion of said air deflector curving downward and toward said front arm of said clip, said lower portion curving downward and outward away from said front arm of said clip, said upper portion of said air deflector being wider than said lower portion, whereby air from the hair dryer is deflected away from the user; and d) a level support on said front arm of said clip to permit the hair dryer to be maintained in an upright position comprising a protruding portion of said front arm of said clip, said protruding portion extending adjacent to but not connected to said distal end of said deflector whereby said distal end of said deflector is between said protruding portion and said barrel.

2. The apparatus of claim 1, wherein said receptacle has the shape of a ring.

3. The apparatus of claim 2, wherein said rear side of said receptacle has at least one hole therein, so that said receptacle can be attached to said clip by having a fastener pass through said hole into a mating hole in said clip.

4. The apparatus of claim 3, wherein said rear arm of said clip has a hole therein, so that said clip can be mounted on a wall hanging member by passing said wall hanging member through said hole on said rear arm of said clip.

5. The apparatus of claim 3, further comprising an adhesive layer being disposed on said outside surface of said rear arm so that said clip can be adhesively attached to a wall.

6. The apparatus of claim 3, further comprising a plurality of serrations being disposed on said inside surfaces of each said front and rear arm to permit the clip to be secured to an article of clothing.

* * * * *